United States Patent [19]

Ozdemir

[11] Patent Number: 4,683,686

[45] Date of Patent: Aug. 4, 1987

[54] SWIMMING POOL COVER

[76] Inventor: Veli Ozdemir, 5074 W. 85th La., Crown Point, Ind. 46307

[21] Appl. No.: 710,107

[22] Filed: Mar. 11, 1985

[51] Int. Cl.[4] ..... E04B 1/343; E04B 7/16

[52] U.S. Cl. ..... 52/64; 52/63; 52/66

[58] Field of Search ..... 52/63, 66, 67, 68, 64; 47/17; 160/196 R, 201, 214

[56] References Cited

U.S. PATENT DOCUMENTS

| | | | |
|---|---|---|---|
| Re. 30,044 | 7/1979 | Huddle | 52/63 |
| 1,896,433 | 2/1933 | Windeknecht | 52/67 |
| 2,603,171 | 7/1952 | Smith | 52/66 |
| 2,986,150 | 5/1961 | Torian | 52/63 |
| 3,415,260 | 12/1968 | Hall | 52/66 |
| 3,424,179 | 1/1969 | Minot | 52/63 |
| 3,534,511 | 5/1966 | Cappella | 52/66 |
| 3,826,049 | 7/1974 | Frommelt et al. | 52/64 |
| 4,073,098 | 2/1978 | Baker | 52/66 |
| 4,175,361 | 11/1979 | Kumode | 52/66 |
| 4,189,882 | 2/1980 | Harrison et al. | 52/63 |
| 4,192,105 | 3/1980 | Morgan | 52/66 |
| 4,381,629 | 5/1983 | Ahn | 52/66 |

FOREIGN PATENT DOCUMENTS

| | | | |
|---|---|---|---|
| 2314371 | 9/1974 | Fed. Rep. of Germany | 52/66 |
| 2026057 | 1/1980 | United Kingdom | 52/67 |

*Primary Examiner*—William F. Pate, III
*Assistant Examiner*—Michael Safavi
*Attorney, Agent, or Firm*—Lee, Smith & Zickert

[57] ABSTRACT

A removable enclosure cover for a swimming pool or the like is disclosed. The enclosure cover includes a plurality of rigid frame members of rectangular panel sections. Th frame members are spaced apart and extend parallel to one another transversely across the pool area. A flexible material is stretched between the frame members. A pair of spaced parallel channel-shaped track members extend along the sides of the pool and guide means is attached to the lower ends of each of the frame members. The guide means has rollers which extend into the interior of the track members. One roller rolls along the bottom of the track members and is mounted on a vertically movable carriage, permitting the frame members to be moved together to one end of the pool deck and collapsing the flexible material to uncover the pool. A threaded adjustment is provided for raising and lowering the carriage with the roller thereon so that the top portion of the track may be clamped between the roller carriage and the bottom of the frame member. The other roller is adapted to engage the sides of the track member to longitudinally guide the frame members.

15 Claims, 8 Drawing Figures

32a
62
52
32
56
64
58
54
34
50
50
34a
60
60
42
44
38
46

4.
44
92a
92
94a
94
5.
48c
48
86
49
88
84
104a
105
104
48a
90a
91a
102a
90
91
102b
104b
90b
98a
91b
96b
106
76
100
98
74
96
4.
5.

44
92
48c
48
49
48a
86
48b
84
82
80b
80a
96
96a
96b
96c
76
90
100
98
70
78
98a
98b
74

44
48c
48b
48a
104a
105
84
78
70
76
104b
106
74

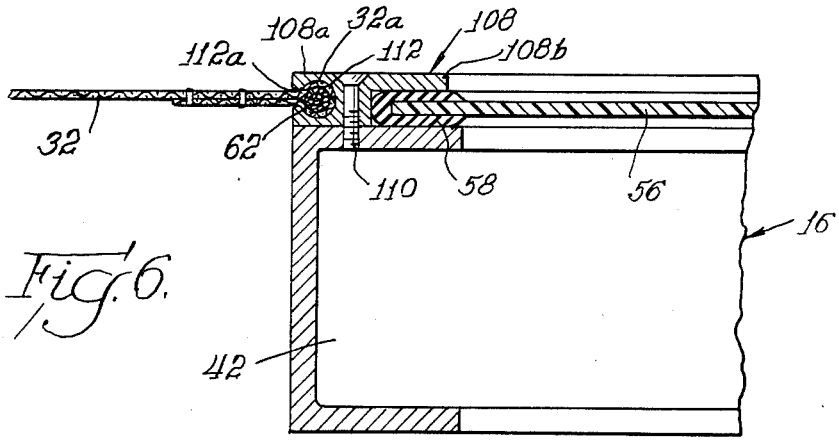
Fig. 6.
Fig. 7.
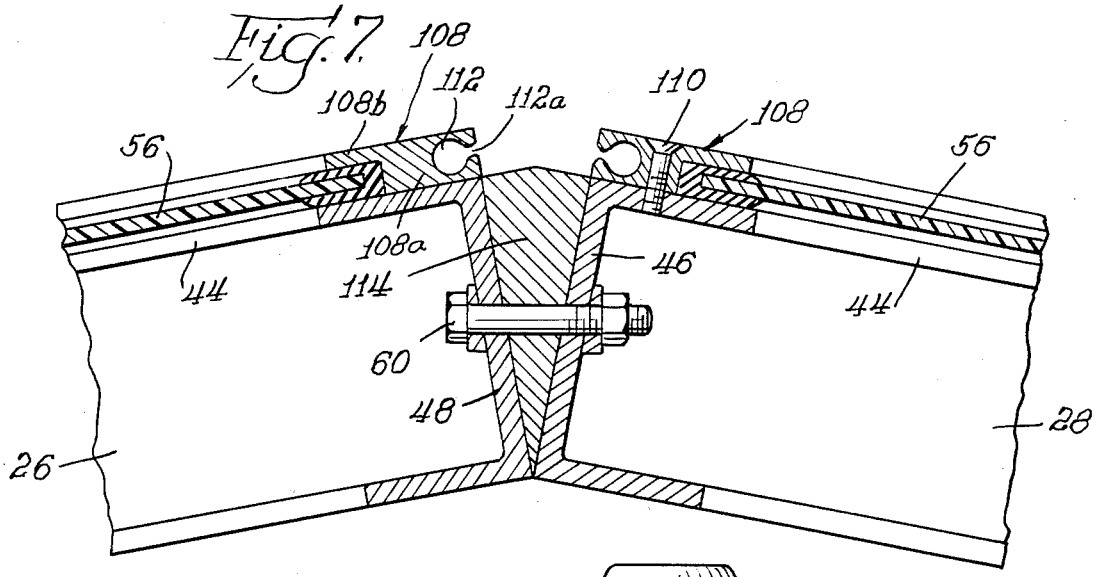
Fig. 8.
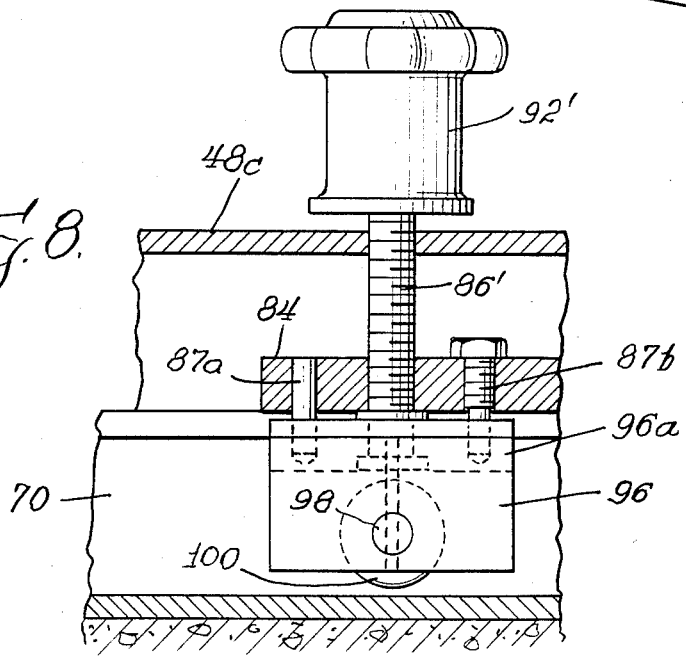

SWIMMING POOL COVER

BACKGROUND AND SUMMARY OF THE INVENTION

This invention relates to a removable enclosure cover for a swimming pool, although the cover may be used for covering any type of an area such as a patio where it desirable to isolate and insulate the area from inclement weather. Structures of this type are desirable to extend the swimming season at least several months if not all year in those climates in which the temperature would ordinarily be too cold for swimming during a good portion of the year. Such structures are useful also in warmer climates where it is desirable to prevent excessive water evaporation from the pool and to provide some shade from the sun.

In-ground swimming pool enclosures available in the market today are prefabricated, onsite, permanent structures. They are built to remain as an integral component of the swimming pool area and they can only be removed by dismantling the structure. They are not adjustable in terms of location and basically they perform only one function, namely, to enclose the pool even during the season when it would be most desirable to have the pool uncovered. With such enclosures, it is not possible to uncover the pool without dismantling the structure.

Various attempts have been made at making slidable swimming pool covers. Examples of such patented structures are Hall U.S. Pat. No. 3,415,260, Minot U.S. Pat. No. 3,424,179, Folkes U.S. Pat. No. 3,469,587, and Folkes U.S. Pat. No. 3,361,144. The structures of these patents, however, have not been successful. Many of these have incorporated folding longitudinal struts which tend to pinch the flexible cover, and are not only difficult to fold, but they are difficult to individually lock in place. In most of the structures, the frame members are single transverse struts and depend upon the foldable longitudinal struts for strength. These single transverse struts lack the strength and stability required for a high quality, long lasting pool cover. The utilization of single transverse struts for the frame members also makes it difficult to both cover the pool and uncover it because of the tendency of the struts to skew as they are pushed either to their open or closed positions. Moreover, none of the prior art devices have provisions for locking the transverse struts in the opened or closed positions either wholly or partially relative to the track in which they are mounted. These devices also contemplate sliding movement rather than free rolling movement between the struts and the tracks in the opening and closing movements.

It is an object of this invention to provide a pool cover which will eliminate the longitudinal struts which have to be locked open in order to cover the pool or folded in order to uncover it. The structure incorporates transverse frame members of rigid rectangular panels preventing skewing of the frame members and giving greater rigidity and stability to the structure.

In accordance with this invention, a removable enclosure cover for a swimming pool or other area is provided. The enclosure cover includes a plurality of frame members with a flexible material extending between the frame members. A pair of spaced parallel channel-shaped track members are preferably imbeded in the walkway surface along the sides of the pool, and a guide means is attached to the lower ends of the frame members and extends into the interior of the channel-shaped track members for rollably engaging the interior of the track members. Thus, the frame members may be guided along the track members toward anda away from one another to selectively cover and uncover the area between the track members.

It is preferred that locking means be provided for locking the guide means in the desired position of adjustment relative to the track members. The guide means preferably includes one roller mounted on a carriage and rotatable about a substantially horizontal axis for rolling along the substantially horizontal surface within the interior of the track members. The locking means preferably includes means for retracting the roller carriage so that portions of the track may be clamped between the carriage and the bottom portion of the frame members.

The frame members in the preferred embodiment comprise a plurality of rectangular sections carrying transparent or translucent panels and connected in end-to-end relationship. The connections may be bolted or they may be in the form of hinged connections so that the structure may be folded.

The guide means also preferably includes a second roller mounted on a substantially vertical axis for rolling along a vertical surface within the interior of the track member, and preferably each guide means includes at least two pair of rollers at each of its ends providing stability for the movement and positioning of the frame members relative to the track members.

BRIEF DESCRIPTION OF THE FIGURES

In the figures.

FIG. 6 is an enlarged sectional side elevational view of a modification of the structure for attaching the rigid panals and the flexible covering material to the frame members.

FIG. 7 is an enlarged sectional end elevational view of the interconnection between adjacent sections of one of the frame members.

FIG. 8 is a sectional side elevational view corresponding to FIG. 3 but showing a modification of the guide means and locking means.

DETAILED DESCRIPTION OF THE PREFERRED EMBODIMENTS

Figure 1:
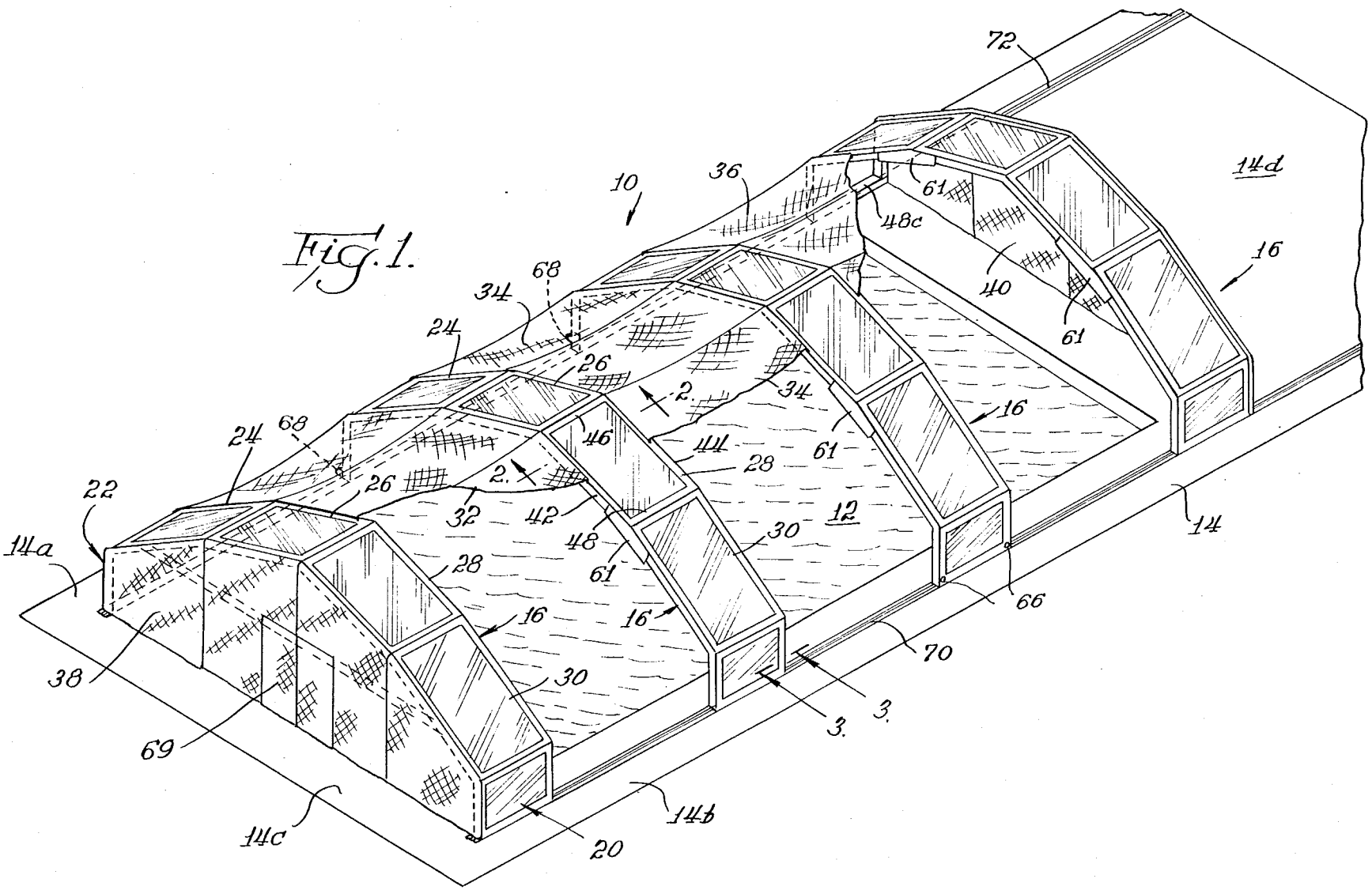
FIG. 1 is a perspective view of a pool cover constructed in accordance with this invention.

In FIG. 1 there is shown a removable enclosure cover 10 constructed in accordance with this invention. The enclosure cover may be used for covering a swimming pool 12 or other area beneath the cover. The swimming pool 12 has a walkway or deck 14 having side portions 14*a* and 14*b*, and end portions 14*c* and 14*d*. It is preferred but not essential that the deck end portion 14*d* be of sufficient depth to pemit the storage of the pool cover when it collapsed, as will be more fully hereinafter described.

In FIG. 1 the enclosure cover is shown in its fully extended position, completely covering the swimming pool 12 or other area beneath the cover. The cover has several rigid frame members 16. In the illustrated embodiment there are four such frame members, although the number will depend upon the length of the area being covered. Each frame member comprises a plurality of rectangular sections which are connected together in end-to-end relationship. The connection between frame member sectios is preferably by means of bolts although the connections could be by means of hinges so that the structure can be folded if it is desired to remove the cover completely from the pool area. Each of the four rigid frame members 16 illustrated comprises a pair of oppositely disposed substantially vertical wall sections 20 and 22 and four ceiling sections 24, 26, 28 and 30 jointed together in an arch. Between the rigid frame members 16 are panels of flexible material which may be a canvas or other easily foldable material. These intermediate foldable panels are identified as panels 32, 34 and 36. End panels 38 and 40 may also be formed of a foldable material which is preferably transparent or translucent.

Figure 2:
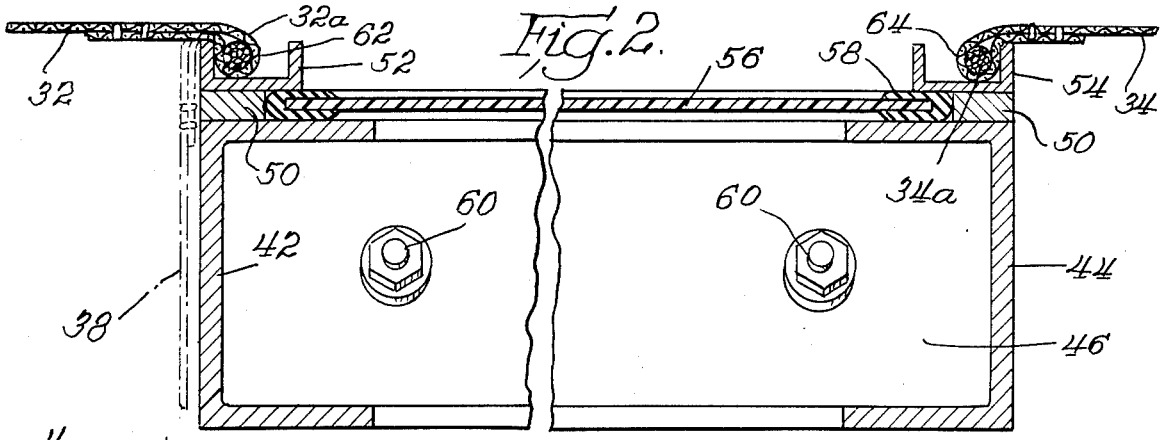
FIG. 2 is an enlarged sectional side elevational view taken substantially along line 2—2 of FIG. 1 showing the rigid transverse panel frame members and the manner of attachment of the flexible covering material therebetween.

The construction of ceiling section 28 of one of the frame members is illustrated in detail in FIG. 2 and it will be appreciated that the other panels of the frame members are similarly constructed. Section 28 comprises a pair of parallel, longitudinally extending, channel-shaped side elements 42 and 44 and a pair of channel-shaped end elements 46 and 48 (shown in FIG. 1 only). In the illustrated construction, the side flanges of each of the four elements 42–48 forming the section 28 extend inwardly. The side and end elements may be welded together or they may be held together by means of suitable fasteners to form a rectangular frame section. Attached to the outer (upper) side flanges of the elements 42, 44, 46 and 48 are spacers 50 which extend around the periphery of the structure formed by the elements 42–48. Outwardly of the spacers 50 and coextensive with the side elements 42 and 44 are a pair of upwardly extending smaller channel elements 52 and 54 which are of greater width than the spacer 50 and thus protrude inwardly over and are spaced from the top web of the larger side elements 42 and 44. This spacing will accomodate a rigid panel 56 of transparent or translucent material such as plexiglass. Around the panel 56 is a resilient bead 58 of flexible material which serves as a weather seal for the panel 56. Bolts 60 may be used to connect the end element 46 of frame section 28 to the opposite end element 48 of the next adjacent frame section 26. If desired, braces 61 may be bolted to the sides of the frame member sections for added rigidity and strength at the joint.

In order to connect the flexible canvas panels 32 and 34 to the rigid frame members 16, the flexible panels are provided with bites or hems 32*a* and 34*a* respectively into which are threaded ropes or flexible cables 62 and 64 respectively. The ropes or cables 62 and 64 and the bite portions 32*a* and 34*a* extend into the upwardly disposed channel elements 52 and 54 and the ends of these ropes or cables may be affixed to formations 66 and 68 such as eye bolts provided at the bottoms of the wall panels 20 and 22. The bite or hem of each flexible canvas panel is thus held in place by the rope or cable within the upwardly disposed channel element 52 or 54 of the rigid panel. If desired, there may be a clamping means substituted for the rope and formations 66 and 68.

The flexible end panels 38 and 40 of the transparent or translucent foldable material extend downwardly from the ends of the rigid frame members which are at the ends of the structure as illustrated in dotted lines in FIG. 2. These may be tied to the pool deck by suitable tie down hardware. A suitable door 69 is provided at least at one end of the cover, as shown in FIG. 1.

Extending along the sides of the pool and preferably embedded in the concrete slab, deck or walkway, is a pair of spaced, parallel, channel-shaped track members 70 and 72. The track members are identical in construction and in FIGS. 3, 4 and 5 track member 70 is shown in detail. This track member has a base 74, sides 76 and 78, and top flanges 80*a* and 80*b*. Top flanges 80*a* and 80*b* close a part of the channel-shaped track member leaving only the longitudinal slot-like opening 82 visible from the top of the track. As shown in FIG. 1, the tracks extend preferably well beyond one end of the pool so that the cover 10 may be stored at that end. For drainage as well as assembly purposes, it is preferred that at least one end of the track be open. The track may be suitably anchored to the cement deck by conventional screw anchors or the like (not shown). In the case of existing pool structures the track members may be mounted on the top surface of the pool deck rather than imbedded in the deck surface.

Attached to the lower ends of each of the frame member wall portions 20 and 22 are guide means which extend into the interior of a respective one of the channel-shaped track members 70 and 72 for engaging the interior of the track members, so that the frame members may be guided along the track members toward and away from one another to selectively cover and uncover the pool area between the track members.

Figure 3:
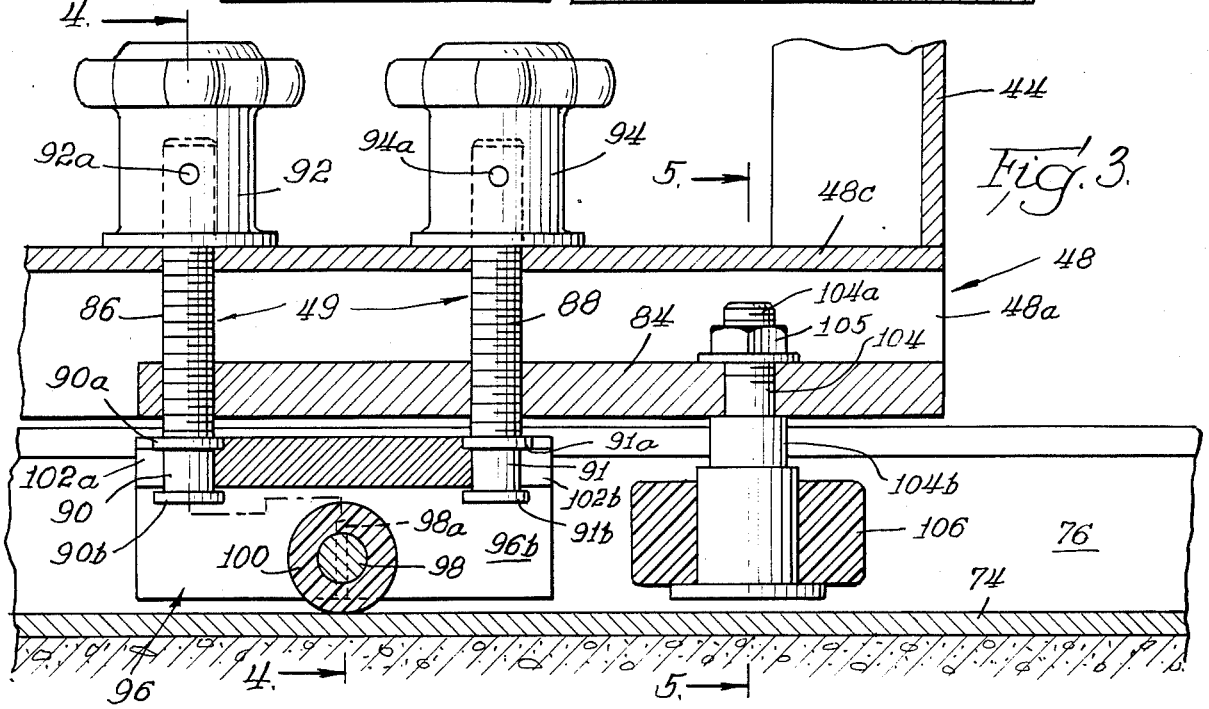
FIG. 3 is an enlarged sectional side elevational view taken substantially along line 3—3 of FIG. 1 and showing a portion of the channel track and guide means for rollably moving the frame members along the track and for locking the frame members in place relative to the track.
Figure 4:
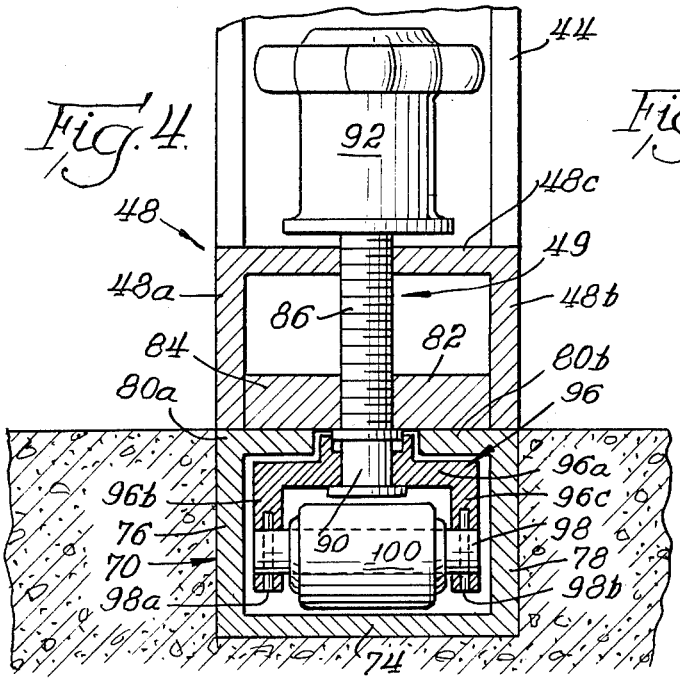
FIG. 4 is a sectional end elevational view taken substantially along the line of 4—4 of FIG. 3.
Figure 5:
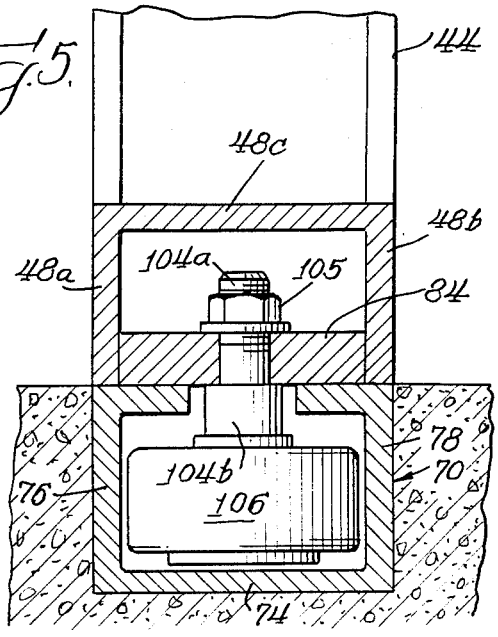
FIG. 5 is a sectional end elevational view taken substantially along line 5—5 of FIG. 3.

As best illustrated in FIG. 3–5, the bottom end element 48 of the frame member side section 20 has a base platae 84 affixed in its open end, preferably by bolts 49 between the depending side flanges 48*a* and 48*b*. Threaded through the base plate 84 and the central flange 48*c* of the wall section end element 48 are threaded members 86 and 88. Threaded member 86 has a shank portion 90 with an enlarged top 90*a* and an enlarged botton 90*b*. Threaded member 88 has a shank portion 91 with an enlarged top 91*a* and an enlarged bottom 91*b*. At the upper ends of the threaded members 86 and 88 are knobs 92 and 94 respectively which are locked in place on the threaded element by means of pins 92*a* and 94*a*, respectively. The shank portions 90 and 91 on the lower ends of the threaded elements 86 and 88, respectively extend into the track 70, and carried on the shank portions 90 and 91 of these two threaded members is a roller carriage 96. The roller carriage has a top plate 96*a* and a pair of depending side plates 96*b* and 96*c*. Extending between the side plates 96*b* and 96*c* is a horizontal axle 98 affixed in position by pins 98*a* and 98*b*. Journaled for rotation on the axle 98 is a roller 100 which may be constructed of nylon or other plastic or elastomeric material. The top plate 96*a* of the carriage 96 has end slots 102*a* and 102*b* which are adapted to accommodate the shanks 90 and 91 of the threaded elements 86 and 88. These slots 102*a* and 102*b* are sufficiently large to accommodate the shank portions but are too small to permit passage of the enlarged portions 90*a* and 90*b* of shanka 90 and enlarged portions 91*a* and 91*b* of shank 91.

Thus the threaded elements 86 and 88 may rotate relative to the roller carriage 96. Depending upon the direction of rotation, the threaded elements will move upwardly or downwardly with respect to the base plate 84 and the central flange 48*c* of the wall section end element and will also cause the roller carriage 96 to move upwardly and downwardly with respect to the base plate 48. The threaded members 86 and 88 are in longitudinal alignment and retain the horizontal carriage axle 98 and the carriage 96 and the roller 100 mounted thereon also in longitudinal alignment. When the knobs 92 and 94 are maniplulated in one direction, they will raise the carriage 96 and the roller 100 permitting the base plate 84 of the side panel 48 to move downwardly into engagement with the top surface of the top flanges 80*a* and 80*b* of the channel-shaped track member while causing the roller 100 to disengage from the base 74 of the track 70. This is shown in FIG. 4. In this position the frame member cannot be rollably moved along the track. Further rotation of the knobs 92 and 94 will cause the carriage 96 to raise until the top plate 96*a* thereof engages the bottom surface of the top flanges 80*a* and 80*b* of the track thus clamping these top flanges of the track between the roller carriage 96 and the bottom plate 84 of the wall panel. Thus the wall panel and the entire rigid frame structure 16 will be clamped in the desired position of adjustment with respect to the track 70. When it is desired to again permit rolling motion of the frame member, the knobs 92 and 94 are rotated in the opposite direction lowering the roller carriage 96 to engage the roller 100 and raise the base plaate 84 of the wall panel 48 out of engagement with the top flanges 80*a* and 80*b* of track 70. This is the position illustrated in FIG. 3.

It is also preferred that there be a laterally stabilizing roller for engaging the side walls 76 and 78 of the channel track. For this purpose there is provided a vertical axle 104 having an upper threaded portion 104*a* which extends through the base plate 84 of the wall panel 48 and is locked in place with a nut 105. The lower enlarged shank portion 104*b* extends through the slotted opening 82 in the channel-shaped track 70, and a roller 106 which is also preferably a nylon roller, is jounaled thereon. This roller also serves as part of the guide means to guide the frame member along the track keeping it in longitudinal alignment.

It is preferred that for stability and smooth rolling action there be provided a horizontal roller 100 and a vertical roller 106 at each end of the wall panels 20 and 22. Thus each of the wall panels 20 and 22 will have a pair of vertical rollers 106 and a pair of horizontal rollers 100.

It will be appreciated that a number of modifications may be made in the preferred embodiment without departing from the spirit and scope of the invention as hereinafter claimed. For example, there may be other and more conventional means for attaching the flexible canvas to the rigid frame members than by means of the hem portions and rope tie downs 62 and 64. Also the precise construction of the rigid panels 20–30 of the frame members may be varied. Each of the frame members though should have a pair of spaced, parallel, transverse portions which in the illustrated embodiment are the channel-shaped side elements 42 and 44. The end elements 46 and 48 and the panel 56 maintain the spacing of the side elements and the rigidity of the frame members. Also the bottom element 48 of the wall sections 20 and 22 preferably flatly engage the top of the track over a substantial longitudinal distance. This provides a solid locked-in-place stability for the frame member 16 and there is no tendency for the frame members to skew or otherwise become misaligned. Also the provision of the rollers 100 and 106 at either end of the wall panel provide stability during movement of the frame member 16.

In FIGS. 6 and 7 there is shown an alternative manner of attaching the rigid panels 56 and the panels of flexible covering material, such as canvas paneal 32, to the frame members 16. In place of the smaller channel elements 52 and 54 and the spacers 50 there is a panel attachment extrusion 108 which is attached (preferably by threaded fasteners 110) to the outer (upper) side flanges of the channel-shaped side elements 42 and 44 and end elements 46 and 48.

Each panel attachment extrusion 108 has a thick body portion 108*a* and a thin flange portion 108*b* which extends inwardly from the body portion from the upper side of the body portion. This flange portion 108*b* extends over and is tightened down (by the fasteners 110) on the resilient bead 58 of flexible material which extends around the edges and ends of the rigid panels 56. Adjacent the outer edge of the extrusion body 108*b* is a longitudinaly extending inwardly enlarged channel or aperture 112 which has a narrow, slot-like mouth or opening 112*a* to the outside of the extrusion (See FIG. 7). The aperture 112 and its mouth 112*a* are of a size and configuration to accept and permit longitudinal movement therein of the rope or cable 62 within the bight 32*a* of the canvas panel 32. The mouth 112*a* is sufficiently narrow, however, to prevent the rope 62 in the bight 32*a* from being pulled laterally through the mouth. Thus the canvas panels 32, 34 and 36 and the rigid panels 56 are securely attached to the frame members 16.

Also shown in FIG. 7 is the manner of interconnecting the end elements 46 and 48 of the adjacent sections of the frame members. In FIG. 1 the sections 20–30 of the frame members meet at obtuse angles. It is preferred that a wedge-like spacer 114 be placed between the end elements of the adjacent sections. The spacer 114 is tapered in accordance with the angle at which the two sections are to be joined, and the spacer is apertured or slotted to accommodate the bolts 60 which are used to connect the end elements together.

In FIG. 8 there is shown a modification of the guide means and locking means. Instead of the two threaded elements 86 and 88 there is a single threaded member 86'. A pair of parallel guide pins 87*a* and 87*b* extend downwardly from the base plate 84 through slotted opening in the track 70 and into coresponding holes in the top plate 96*a* of the carriage 96. The guide pins 87*a* and 87*b* are used to guide the roller carriage 96 as it is raised and lowered relative to the track 70 and base plate 84 by the manipulation of the single knob 92'. The pins may be force fitted as shown on pin 87*a* or threaded into the base plate 84 as shown on pin 87*b*.

While in the preferred embodiment the roller carriage also acts as the clamp for clamping the frame members in position, it is not essential that this carriage double as a clamp. The roller carriage could be fixed in place and it could carry not only the horizontal roller but also the vertical roller. Other locking means could be provided for clamping the base plate 84 and the end element 48 of the wall sectio in flat position against the top of the channel track 70.

The frame members 16 may be pushed together and moved to one end of the swimming pool to provide in essence a cabana structure at that end of the pool and opening the pool itself. This is particularly desirable when the outside temperature is warm and comfortable.

It may be seen that this invention provides a strong, sturdy cover for a pool, which cover may be easily pushed between pool covering and pool uncovering positions and may be locked in the desired position.

What is claimed is:

1. A removable enclosure cover for a swimming area or the like; said enclosure cover including a plurality of frame members, each frame member comprising a plurality of rectangular sections connected in end-to-end relataionship with each rectangular section including a panel of rigid material, panels of a flexible material extending between adjacent frame members, a single pair of spaced parallel, track members on opposite sides of the area being covered, roller guide means attached to each of said frame members and each such roller guide means extending into rolling engagement with a respective one of said single pair of track members; whereby said frame members carrying said rigid panels may be guided along said track members toward and away from one another to selectively and respectively collapse and expand said panels of flexible material to cover and uncover at least a portion of the area between said track members.

2. The structure of claim 1 wherein locking means is provided for locking said guide means in the desired position of adjustment relative to said track members.

3. The structure of claim 1 wherein said rigid material is transparent or translucent.

4. The structure of claim 3 wherein said flexible material is opaque.

5. The structure of claim 1 wherein said track members are channel shaped and said roller guide means includes at least one roller mounted on a substantially horizontal axis for rolling along a substantially horizontal surface within one of said channel-shaped track members.

6. The structure of claim 5 wherein said roller guide means includes at least one roller mounted on a substantially vertical axis for rolling along a vertical surface within the interior of said track member.

7. The structure of claim 2 wherein said locking means includes a clamping member selectively movable into engagement with said track member to prevent movement between said guide means and said track member.

8. The structure of claim 1 wherein panel attaching means is provided for connecting said panels of flexible material and said rigid panels to said rectangular sections of the frame members, said panel attaching means comprising a plurality of elongated attaching members each having an inwardly facing side portion for extending over and in gripping engagement with portions of one of the rigid panels and an outwardly facing side portion in gripping engagement with portions of said flexible material panel.

9. The structure of claim 8 in which each said attaching member outwardly facing side portion has an aperture extending the length of said attaching member and a narrow, slot-like side opening extends from said aperture to the outside wall of said attaching member along the length of said attaching member, and said flexible material has an end portion which is enlarged to slide longitudinally within said aperture and side opening but will not pul laterally out of said aperture and side opening.

10. A removable enclosure cover for a swimming pool area or the like; said enclosure including a plurality of rigid frame members; a flexible material extending between adjacent frame members; a paiar of spaced, paraallel, channel-shaped track members on opposite sides of the area being covered; guide means attached to each of said frame members and extending into a respective one of said channel-shaped track members, said guide means carrying at least one pair of rollers mounted on axes which are transverse to one another for rolling along transverse surfaces within one of said track members, whereby said frame members may be guided along said track members toward and away from one another to selectively cover and uncover the area between said track members, and locking means including a clamping member selectively movable into enagement with the associated track member to prevent relative movement between said guide means and said track members.

11. The structure of claim 10 wherein said guide means includes at least two pair of rollers, one roller of the first pair being mounted on an axis which is transverse to the other roller of that pair and parallel to the axis of the corresponding roller of the second pair of rollers.

12. The strucuture of claim 10 wherein each of said track members has a substantially horizontal top flange extending along the top of said track member, and said locking means clamping member is selectively movable into engagement with said top flange to prevent relative movement between said guide means and said track member.

13. The structure of claim 12 wherein carried at each end of each of said frame member rectangular sections is a base element; said guide means includes a roller carriage, a first roller mounted on said carriage for rotation about a substantially horizontal axis, and said locking means includes threaded means interconnecting said base element and said roller carriage and adjustabale for moving said roller carriage and said base element relataive to one another, whereby the top of said roller carriage serves as the locking means clamping member and said first roller may be raised and the top flange of the track member may be clamped between the top of said roller carriage and said base element to lock said guide means in the desired position within said track member.

14. The structure of claim 13 wherein said threaded means includes a pair of spaced, parallel threaded elements journaled for rotation in said roller cariage and in threaded engagement with said base element, and means for facilitating manual rotation of said threaded elements to adjustably move said roller carriage relative to said base element.

15. The structure of claim 13 wherein said guide means further includes a second roller mounted for rotation about a substantially vertical axis.

* * * * *